US006096249A

United States Patent [19]

Yamaguchi

[11] Patent Number: 6,096,249

[45] Date of Patent: Aug. 1, 2000

[54] METHOD FOR MOLDING FIBER AGGREGATE

[75] Inventor: Masanao Yamaguchi, Osaka, Japan

[73] Assignee: Teijin Limited, Osaka, Japan

[21] Appl. No.: 09/117,376

[22] PCT Filed: Dec. 2, 1997

[86] PCT No.: PCT/JP97/04396

§ 371 Date: Jul. 29, 1998

§ 102(e) Date: Jul. 29, 1998

[87] PCT Pub. No.: WO98/24958

PCT Pub. Date: Jun. 11, 1998

[30] Foreign Application Priority Data

Dec. 5, 1996 [JP] Japan ..... 8-325278
Dec. 17, 1996 [JP] Japan ..... 8-336771

[51] Int. Cl.[7] ..... D04H 1/54

[52] U.S. Cl. ..... 264/40.3; 264/517; 264/121; 264/122

[58] Field of Search ..... 264/40.3, 517, 264/122, 121

[56] References Cited

U.S. PATENT DOCUMENTS 5,378,296 1/1995 Vesa ..... 425/80.1
5,571,465 11/1996 Gill et al. ..... 264/121
5,587,121 12/1996 Vesa ..... 264/126

FOREIGN PATENT DOCUMENTS 62-152407 7/1987 Japan .
7324266 12/1995 Japan .
9-84972 3/1997 Japan .
9-176946 7/1997 Japan .

*Primary Examiner*—Mary Lynn Theisen
*Attorney, Agent, or Firm*—Sughrue, Mion, Zinn, Macpeak & Seas, PLLC

[57] ABSTRACT

This invention provides a method for producing a cushion structure having excellent quality in a short time by the final heat-molding of a fiber aggregate containing binder fibers by compression molding a fiber aggregate in multiple stages leaving the thermal shrinkage margin, passing hot gas through a by-pass channel on the side wall part of the molded article to eliminate the problem of insufficient heating of the side face of the molded article and detecting the completion of the filling of the fiber aggregate into the mold cavity by the pressure variation in the mold cavity.

8 Claims, 4 Drawing Sheets

(A)

(B)

METHOD FOR MOLDING FIBER AGGREGATE

DETAILED DESCRIPTION OF THE INVENTION

1. Technical Field

This invention relates to a method for forming a cushion structure for seat of automobile, airplane, etc., from a fiber aggregate. More particularly, this invention relates to a method for molding a fiber aggregate composed of a matrix consisting of crimped synthetic staple fibers and binder fibers having a melting point lower than that of the matrix fiber and dispersed in the matrix by filling a mold cavity with the fiber aggregate and molding the aggregate under heating.

2. Background Arts

Inexpensive urethane foam has been frequently used in general as a cushion material for a seat having complicated form such as a seat for automobile, airplane, etc. However, urethane foam has problems such as the emission of toxic gases in combustion and the difficult recycling use, and a new molding material has been keenly desired as a substitute for urethane foam.

Materials as a substitute for urethane foam have been desired recently to meet the above questions. A cushion structure produced by using a fiber aggregate has been attracting much attention as a material to solve various problems mentioned above. The fiber aggregate is composed of a matrix consisting of synthetic staple fibers and binder fibers having a melting point lower than the staple fibers and dispersed in the matrix. A cushion structure can be formed by filling the fiber aggregate in a mold cavity, closing the mold and performing the hot-molding of the aggregate to effect the thermal fusion of the binder fibers in the fiber aggregate.

The filling of a fiber aggregate in a mold cavity has been performed hitherto e.g. by preparatorily shaping a lump of a fiber aggregate to a definite size and placing the preparatorily shaped aggregate in the mold cavity by hand or by an automatic machine such as an industrial robot.

This process necessitates the procedures of the preparatory shaping of a fiber aggregate and the filling of the shaped aggregate into a mold. The additional process of the preparatory shaping results in the increase of cost and necessitates a temporary holding space to hold the preparatorily shaped fiber aggregate.

A method to transport small lump of fiber aggregate into a mold by the aid of pressurized air stream without preparatorily shaping the fiber aggregate is proposed e.g. in the Japanese Patent (TOKKAISHO 62-152407) as a method for solving the above problems. According to the method, the unshaped fiber aggregate is transported to an opener by a conveyor and the opened small blocks are filled in a mold cavity by the aid of pressurized air stream generated by a blower. The fiber aggregate filled in the mold is heated to effect the firm bonding of the fibers with the binder fibers in the fiber aggregate and the conversion of the aggregate into a cushion structure having a form corresponding to the cavity form of the mold.

These conventional processes lack the function to detect and judge the completion of the filling of the fiber aggregate in the mold cavity. Accordingly, the necessary amount of the fiber aggregate to be filled in the mold cavity is preparatorily weighed for each batch before filling in the cavity. It is indispensable to perform an additional process to preparatorily weigh the filling amount of the fiber aggregate prior to the filling of the aggregate in the mold cavity. The additional process necessitates additional labor and time to cause a great problem in the reduction of molding cost.

The process from the filling of the fiber aggregate into the mold cavity to the heating and cooling of the filled aggregate should be performed in an extremely short time for reducing the molding cost by mass-production such as the production of a cushion material for automobile. Preferably, the whole process is completed in one mold cavity without passing through several steps. An attempt to perform the above process is disclosed e.g. in a Japanese Patent Laid-Open (TOKKAIHEI 7-324266). In this process, a fiber structure (cushion material) is formed by using a mold made of a gas-permeable material and passing hot air and cold air through the fiber aggregate filled in the mold cavity.

A certain extent of heat is lost during the passage of hot air to the mold cavity in the above molding process to prolong the time necessary for heating the binder fiber to a temperature sufficient for the melting of the fiber. For shortening the hot-molding time, it is necessary to increase the blowing speed of hot air to increase the thermal transmission efficiency to the fiber aggregate, however, the wind pressure also increases by increasing the blowing speed of hot air. The heated fiber aggregate lost its elasticity to an extent becomes easily deformable by the influence of the increased wind pressure. In this case, the wall thickness of the molded product becomes too thin to get a product having desired wall thickness. Furthermore, hot air and cold air are easily passable through the center part of the mold cavity in contrast to the side face of the cavity resistant to pass the hot air, etc., and, accordingly, the above method causes the quality difference of the product between the middle part and the side part to fail in getting a uniform molded product.

Various methods have been proposed to solve the problems. For example, the hot air velocity is increased until the binder fiber reaches the softening temperature and decreased thereafter, or the fiber aggregate is cooled by a low-speed cooling air when the fiber aggregate is in molten or softened state and the cooling speed is increased when the aggregate becomes resistant to deformation. Such methods cause the following problem in the case of shortening the time necessary for the initial temperature-increasing step or the initial cooling step.

The problem is the failure in getting a cushion structure having a desired dimension caused by the thermal shrinkage of the fiber aggregate during the heating and cooling cycles. The problem is especially serious for shortening the heating and cooling cycles in the case of producing a cushion structure from a fiber aggregate and is to be solved for producing a cushion structure having excellent quality and desirable shape.

Means for Solving the Problems

The present invention relates to a molding method to form a cushion structure from a fiber aggregate composed of a matrix consisting of crimped synthetic staple fibers and containing binder fibers having a melting point lower than that of the staple fibers and dispersed in the matrix.

More particularly, the present invention, is a molding method of a fiber aggregate to form a cushion structure by filling an loosen fiber aggregate into a cavity of a mold having air-permeability by the aid of a carrier gas flow, pressing the fiber aggregate filled in the mold cavity to a prescribed bulk density, passing hot air through the compressed fiber aggregate to effect the heating and melting of the binder fibers and the partial fusion of the fibers of the fiber aggregate with each other and the cooling of the aggregate by passing cooling air flow through the aggregate to effect the solidification and fixing of the fused part.

In order to attain the molding time to mold the cushion structure and the excellent quality of the product, the mold is pressed stepwise and/or continuously at least once leaving a compression margin before getting the final shape of the cushion structure in the case of heating and/or cooling the fiber aggregate to convert the aggregate into the cushion structure. The thermal shrinkage of the fiber aggregate is relaxed by this process and a cushion structure having the designed final form can be produced by further pressing the aggregate to an extent corresponding to the compression margin.

Another characteristic of the present invention is to form a bypass channel of hot air encircling the outer side face of the mold cavity essentially excluding the upper and lower faces of the mold, to pass hot air through the fiber aggregate filled in the mold cavity and to simultaneously pass the hot air through the bypass channel. The fiber aggregate can sufficiently be heated by this process to obtain a product having excellent quality in contrast to conventional processes to give insufficient heating of the fiber aggregate at the side face of the mold and fail in getting a cushion structure having sufficient quality.

A further characteristic of the present invention is to detect the pressure change of the carrier gas flow according to the progress of the filling of the fiber aggregate in the aforementioned mold cavity and stop the filling operation of the fiber aggregate into the mold cavity when the pressure variation reaches a preset level showing the completion of the filling of the fiber aggregate in the mold cavity. The completion of the filling of the fiber aggregate in the mold cavity is automatically detected by this process to dispense with the procedure of weighing the fiber aggregate to be filled in the mold cavity and enable the shortening of the molding time and the simplification of the process.

BEST MODE FOR CARRYING OUT THE INVENTION

There is no particular restriction on the material of the crimped synthetic staple fiber constituting the matrix of the fiber aggregate of the present invention. Preferable examples are staple fibers made of polyethylene terephthalate, polybutylene terephthalate, polyhexamethylene terephthalate, polytetramethylene terephthalate, poly-1,4-dimethylcyclohexane terephthalate, polypivalolactone or their copolyester, blended fiber aggregate composed of the above fibers or a conjugate fiber composed of two or more of the above polymer components. The cross-section of the staple fiber may be circular, flat, modified form or hollow. The crimp applied to the synthetic staple fiber is preferably actualized crimp. The actualized crimp can be attained by mechanical methods such as the crimping with a crimper, anisotropic cooling in spinning, heating of a side-by-side or an eccentric sheath-core conjugate fiber, etc.

Preferable examples of the binder fiber are polyurethane elastomer fiber or polyester elastomer fiber, especially a conjugate fiber containing these polymers in a state exposed on a part of the fiber surface. The binder fiber is mixed in the aforementioned matrix fiber in dispersed state in an amount suitable for the required performance of the objective molded product.

The mode for carrying out the present invention is described in detail referring the Figures.

Figure 1:
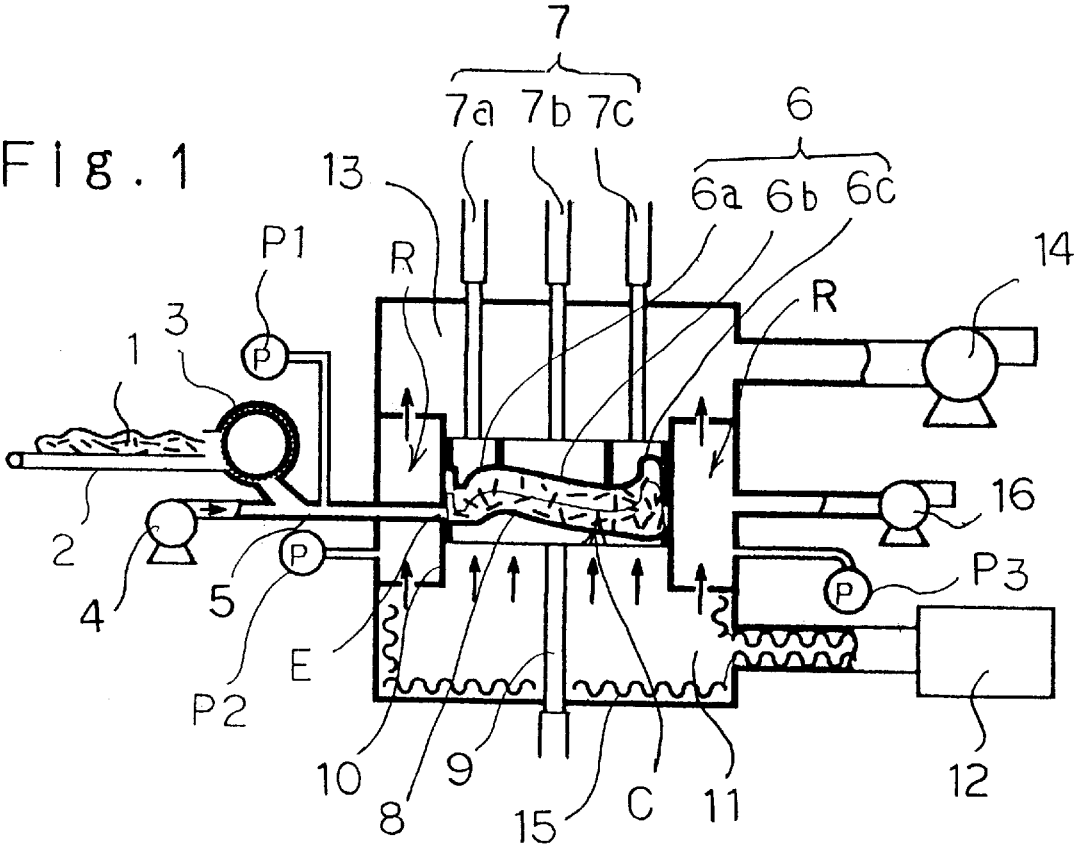
FIG. 1 is a partial frontal cross-section view as an example of the apparatus for working the process of the present invention.

FIG. 1 is an example of an apparatus for suitably carrying out the method of the present invention. In the figure, the sign 1 is a fiber aggregate, 2 is a conveyor, 3 is an opener, 4 is a blower and 5 is a duct. The fiber aggregate 1 is placed on the conveyor 2, transported to the opener 3 by the conveyor 2 and further to the mold cavity C through the duct 5 and filled in the cavity. In the above process, the fiber aggregate loosen by the opener 3 is carried on a carrying air flow generated by the blower 4 and transported to the mold cavity C through the duct 5.

The construction of the mold to be used in the present invention is explained as follows. The sign 6 (6*a* to 6*c*) is an upper mold divided into plural sections, 7 is an actuator to vertically move the upper mold, 8 is a lower mold, 9 is an actuator to vertically move the lower mold and 10 is a stationary mold frame to guide the upper and the lower molds 6 and 8 sliding on the inner wall surface of the frame. The upper mold 6 divided into three parts 6*a* to 6*c* is shown as an example, however, the division is not essential requirement and a monolithic mold may be used for the purpose. The term "mold cavity" used in the present invention means the forming space of a mold formed by the upper and the lower molds 6 and 8 and the mold frame 10.

In the mold having the above construction, the apparatus for carrying out the method of the present invention is characterized by a bypass channel R capable of by-passing the hot air and/or cold air in such a manner as to surround the outer circumference of the side surface excluding the upper and the lower faces of the mold cavity.

The heat of the hot air is sufficiently transmitted to the fiber aggregate through the outer circumference of the side face of the mold cavity C by passing the hot air through the bypass channel R. Accordingly, the problem of the generation of molding unevenness caused by the difference of hot air quantity or velocity passing through the center part and the side wall part of the mold cavity C can be extremely skillfully solved by the bypass channel R in contrast to conventional process free from bypass channel.

The other significant characteristic of the present invention is the aforementioned hot air blowing system capable of sending air into the mold cavity C and the bypass channel R without losing the original heat-quantity of the hot air before the arrival of the hot air to the mold cavity C and the bypass channel R. To achieve the above purpose, the wall surfaces of the blowing chamber 11 and the blowing duct to cause the loss of heat from the hot air are provided with heaters 15 and heated at a prescribed controlled temperature. A prescribed quantity of heat can be applied to the fiber aggregate filled in the mold cavity by this construction without increasing the flow rate of hot air sent to the mold cavity C. The heater 15 may be attached to the inner wall face of the blower chamber 11 or the blowing lines as shown in the FIG. 1 or to the outer wall face of the chamber, etc. It is essential to prevent the lowering of the hot air temperature below a permissible level, and any heating means capable of achieving the purpose can be used. For example, the wall face may be heated directly with an electric heater, etc., or heated indirectly with the vapor of a thermal medium generated by heating the thermal medium sealed in a jacket.

The apparatus shown by the FIG. 1 is provided with pressure gauges P1 to P3 to detect the pressure change of the carrier gas flow according to the progress of the filling operation. These pressure gauges P1 to P3 are provided to judge whether the pressure variation of the carrier gas flow according to the progress of the filling operation reaches a level showing the completion of the filling of the fiber aggregate in the mold cavity. The pressure gauge P1 detects the pressure in the duct 5, the gauge P2 detects the pressure in the mold cavity C at the inlet side of the fiber aggregate and the carrier gas flow and the gauge P3 detects the pressure in the exhaustion chamber. The pressure gauge is preferably a diaphragm-type pressure gauge, a manometer-type pressure gauge, etc., especially a pressure gauge capable of detecting a slight variation of pressure. Preferably, both of the pressure gauges P1 and P2 are used in combination as shown by the present example, however, the use of either one of the gauges is also allowable. If necessary, one or more additional pressure detectors may be installed at other places (for example, between the upper and the lower molds 6 and 8) to receive the information from the detectors and collectively judge the information in combination with information transmitted from the former gauges.

In the present apparatus, the fiber aggregate 1 is filled in the mold cavity C together with the carrier gas flow generated by the blower 4 while keeping the upper and lower molds 6,8 vertically separated from each other (the state shown in the Figure). At the same time, the carrier gas flow introduced into the mold cavity C is exhausted by the blower 16 through the bypass channel R acting also as the exhaustion chamber. When the filling of the fiber aggregate into the mold cavity C is finished, the upper and the lower molds 6,8 are moved downward and upward respectively to compress the fiber. aggregate filled in the mold cavity to a prescribed bulk density.

It is important in the above method of the present invention to allow for the thermal shrinkage of the fiber aggregate in the mold cavity C in molding with the upper and the lower molds 6 and 8. In another word, it is essential to perform a preliminary compression step leaving a compression margin in place of compressing the fiber aggregate at a stroke to the final shape of the cushion structure to be formed by the molding process.

That is to say, the process until the complete filling of the mold cavity C with the fiber aggregate carried by the carrier gas flow generated by the blower 4 may be the same as that of the conventional process, however, in the process to press the mold after closing the blowing port of the fiber aggregate, the compression is temporarily stopped before getting the final shape of the molded cushion structure to leave a compression margin.

Figure 2:
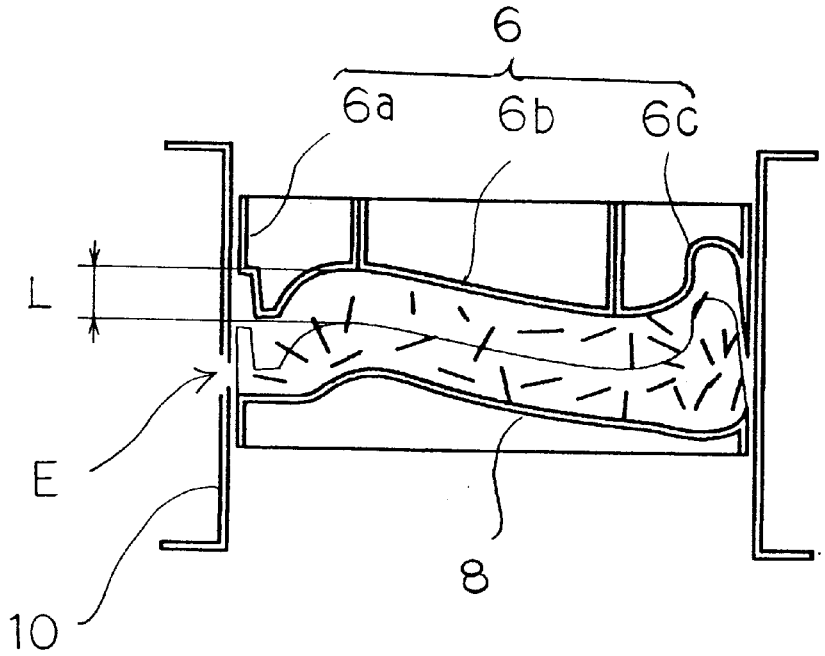
FIG. 2 is a partial frontal cross-section view showing the state of a fiber aggregate compressed leaving a compression margin for forming a cushion structure having a desired shape. The FIG. 2-(A) is an explanatory drawing showing the state of a fiber aggregate compressed leaving the compression margin and the FIG. 2-(B) is a drawing to show the state compressed to the final form to obtain the cushion structure having the desired shape.
Figure 2:
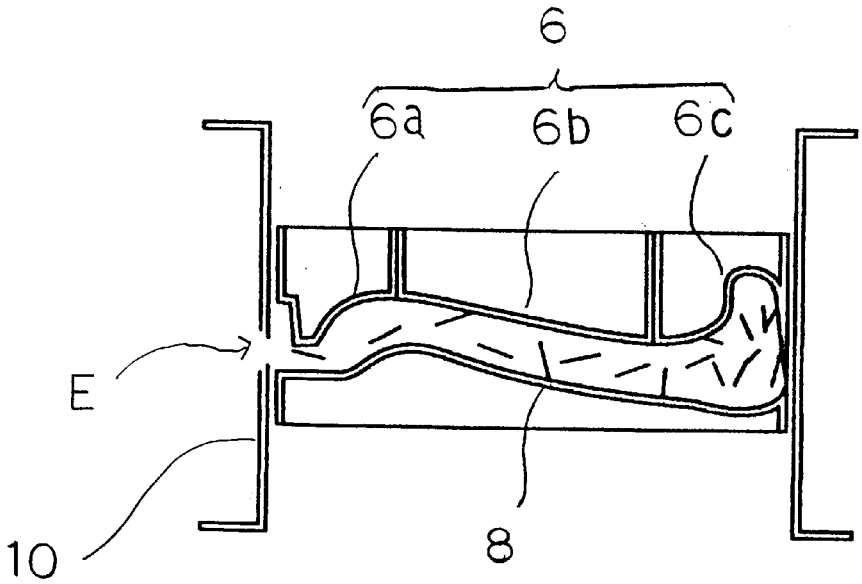

The procedure is described in detail with reference to the FIG. 2. The FIG. 2-(A) shows the state attained after compressing a fiber aggregate filled in the mold cavity C stepwise and/or continuously at least once leaving a compression margin (L). This state can be achieved by moving the divided upper molds 6*a* to 6*c* downward with actuators 7*a* to 7*c*. The preliminary compression of the fiber aggregate to a position leaving the compression margin (L) may be performed stepwise in plural steps, however, the aggregate is compressed usually at a stroke to the position leaving the above compression margin (L). The fiber aggregate is heated to a prescribed temperature by passing hot air through the mold cavity C and the bypass channel R while leaving the compression margin (L). The binder fiber is selectively melted by this process and thermally welded to the matrix fibers or other binder fibers.

The above-mentioned multistage compression leaving a compression margin prevents the thermal shrinkage of the fiber aggregate during the molding process to cause the problem of the final cushion structure having the shape shrunk from the designed final dimension. Needless to say, the molded article having a desired shape cannot be produced by converting the fiber aggregate into a cushion structure without using the above-mentioned compression process. Such defects are actualized especially by shortening the heating time in order to shorten the molding time. Accordingly, although the compression process of the present invention to leave a compression margin apparently cause the longer molding time, the process is essential to get a cushion structure having high quality spending consequently shortened molding time.

The partially welded part formed in the fiber aggregate is fixed by circulating cooling air flow and cooling the molded article. During the cooling process, the upper mold 6 and/or the lower mold 8 are compressed stepwise and/or continuously at least once in the compressing direction to a position to get the final shape of the cushion structure. The compression may be carried out in plural divided steps, however, it is usually performed at a stroke. The cooling air is passed through the fiber aggregate by this procedure to cool the aggregate to a prescribed temperature and solidify the welded part originated from the binder fiber in the fiber aggregate. Thereafter, the lower mold 8 is moved downward by the actuator 9 and the molded article is taken out of the mold cavity C to complete a single molding cycle. The mold is moved to a prescribed position to prepare the reception of the fiber aggregate in the cavity and start the next molding cycle starting from the process to fill an loosen fiber aggregate on a conveyor into the mold cavity.

The compression margin (L) depends upon various factors such as the bulk density and the thickness of the final cushion structure obtained by the molding process, however, it is preferably in the range of 5 to 100 mm in general. When the compression margin (L) is smaller than 5 mm, the sink defect of the fiber aggregate in hot molding becomes large to give a product having a wall thickness thinner than the designed level and the transfer of the prescribed mold form becomes difficult. On the contrary, if the compression margin (L)is to be increased beyond 100 mm, the bulk density of the fiber aggregate compressed essentially immediately before passing the hot air has to be decreased. Accordingly, molding unevenness is liable to occur by the variation of the penetration resistance of hot air and the influence of the wind pressure difference between the center part and the side wall part of the mold cavity.

The molding of a cushion structure proceeds according to the above procedures, and the automatic judgement of the completion of the filling of the fiber aggregate in the mold cavity C is a further characteristic of the present invention. Details of the procedure is explained as follows.

The pressure in the mold cavity is detected by pressure gauges P1 to P3 during the filling operation of the fiber aggregate. The carrier gas flow flows smoothly from the fiber aggregate inlet port E of the mold cavity C to the bypass channel R before starting the filling operation, that is, in a state free from the fiber aggregate in the mold cavity. In this case, the fiber aggregate inlet port E is supplied with pressurized air stream by the blower 3. The air is sucked through the bypass channel R at the side opposite to the inlet port E by the exhauster 16, and the fiber aggregate 1 resistant to the passage of air flow is not yet filled in the mold cavity. Accordingly, the pressure drop between the fiber aggregate inlet port E and the bypass channel R is small before starting the filling operation of the fiber aggregate.

According to the progress of the filling of the fiber aggregate 1 in the mold cavity, the filled fiber aggregate forms a resistor to the passage of air to gradually increase the air-flow resistance. The pressure drop of the carrier gas flow between the fiber aggregate inlet port E and the bypass channel R increases according to the accumulation of the aggregate to gradually increase the pressure drop between the fiber aggregate inlet port and the bypass channel R. In other words, the filled fiber aggregate acts as a resistor to the flow of air at the side of the fiber aggregate inlet port to hinder the air flow according to the progress of the filling operation and increase the air pressure. As a result, the pressure (detected by the pressure gauges P1 and/or P2) increases by about 10 to 100 mmAq from the start of the filling operation. The pressure (detected by the pressure gauge P3) at the other exhaustion chamber side becomes negative and drops by about 10 to 100 mmAq from the initial detected pressure level according to the gradual decrease of the air flow rate from the mold cavity C to the exhaustion chamber 10.

The complete filling of the fiber aggregate 1 in the mold cavity C is detected by monitoring the variation of the pressure, and the completion of the filling is judged whether the pressure levels detected by the pressure gauges P1 to P3 reach respective preset values preparatorily determined by experiment, etc. The judgement can be carried out by visually inspecting the pressure level indicated by the pressure gauges P1 to P3, however, it is preferable in general to convert the detected pressure levels of the pressure gauges P1 to P3 into electric signals by a conventional automatic control equipment and automatically judge the completion of the filling operation by the electric signals. Since the preset pressure levels to be used as the criteria of the judgement of the complete filling vary with the bulk density of the fiber aggregate 1 to be filled in the mold cavity, the size of the cavity, the air pressure blown into the mold cavity C, etc., the levels should be preparatorily determined by experiments, etc., under these practical conditions.

It has been described before that the conventional air-blowing process for the filling of a fiber aggregate has the problem of "the filling of excess fiber aggregate at the center part of the mold cavity C having increased velocity of the air flow carrying the fiber aggregate and the tendency of the insufficient filling of the fiber aggregate at the side wall part having low air flow rate relative to the center part". The problem is solved in the present invention by the following means to be described in detail with reference to the FIG. 3.

Figure 3:
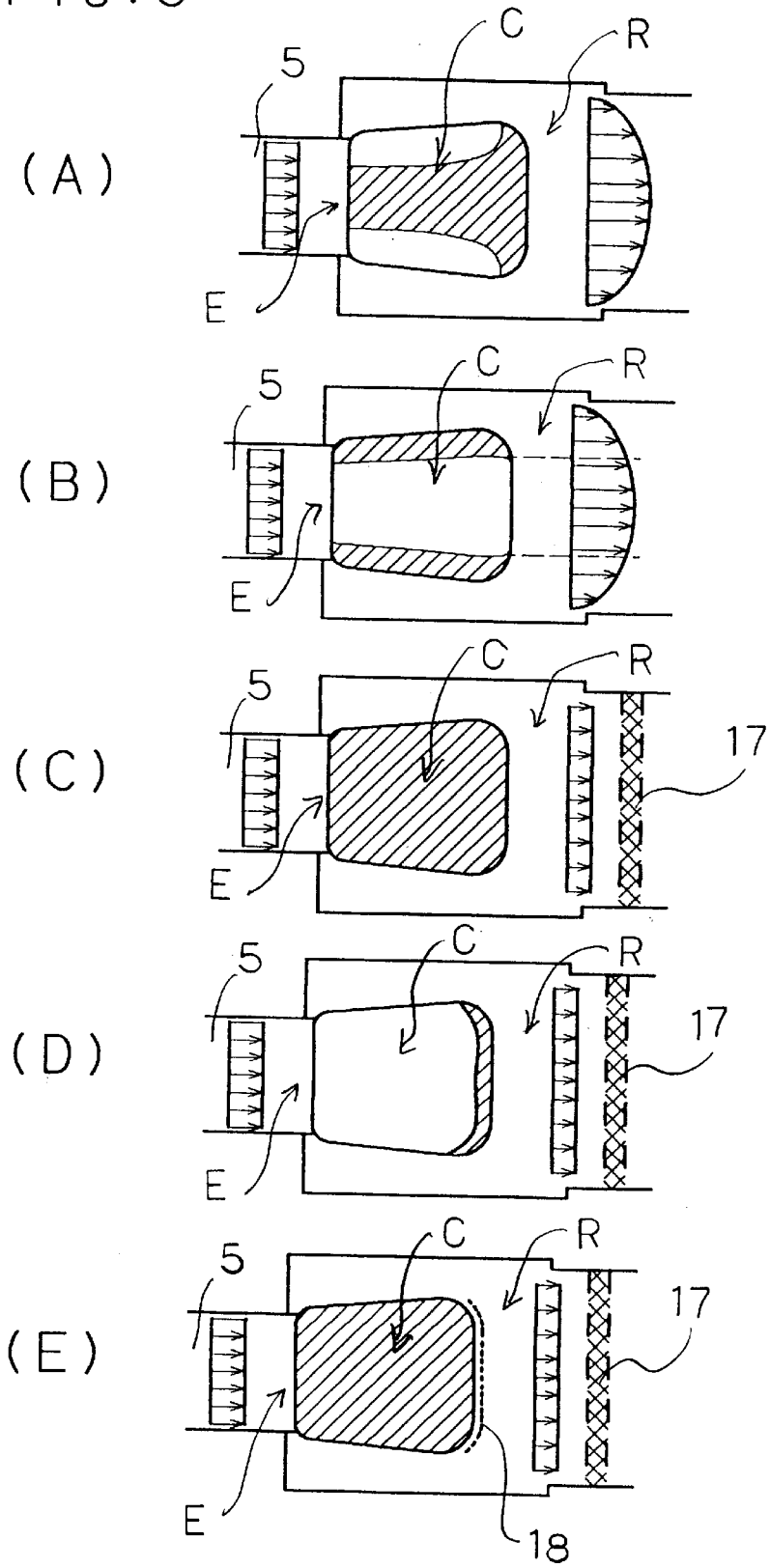
FIGS. 3(A)–(E) are plane views showing the method for exhausting the carrier gas flow of the fiber aggregate from the mold cavity.
Figure 4:
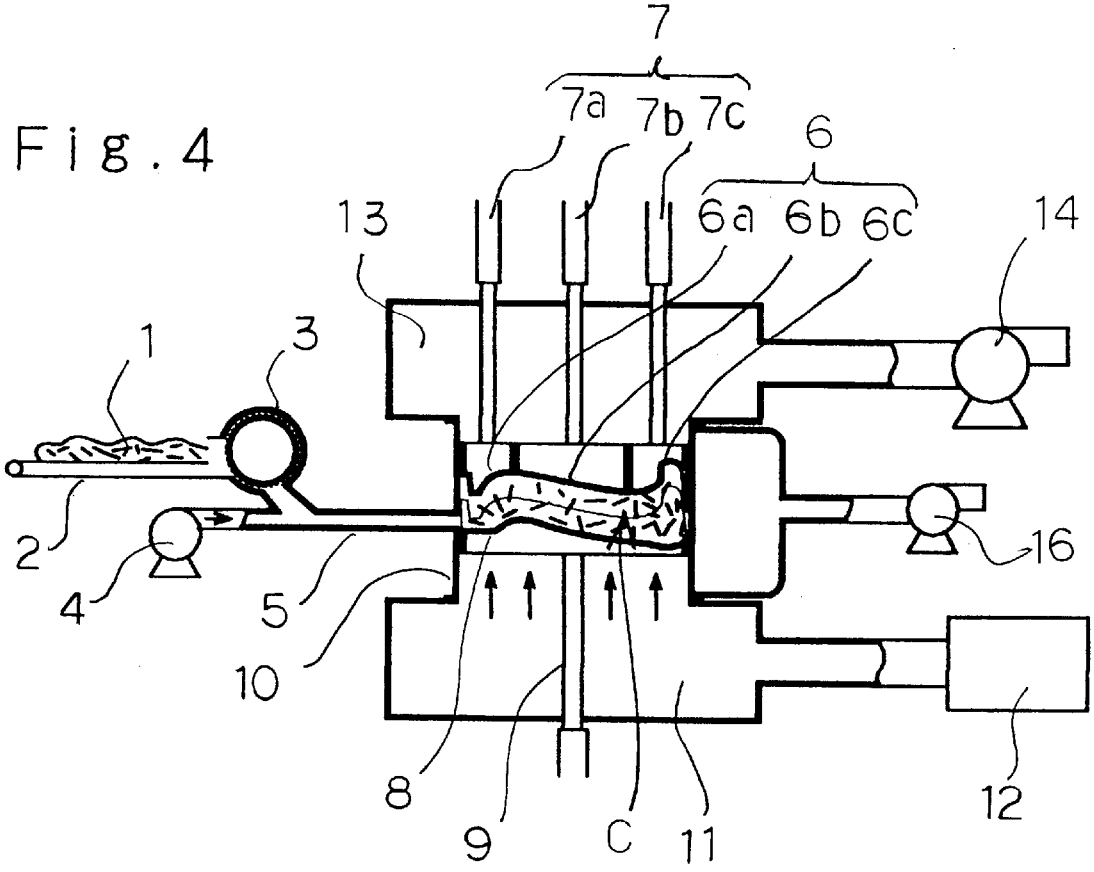
FIG. 4 is a partial frontal cross-section showing a conventional molding method of fiber aggregate.

The FIGS. 3-(A) to (E) are partial plane views of the FIG. 1 showing the filling states of the fiber aggregate in the mold cavity C. The figures are schematically drawn to simplify the explanation, and the fiber aggregate is shown by hatching (slant lines) in the figures.

The FIG. 3-(A) shows the filling state of the fiber aggregate by the conventional air-blowing method. The velocity distribution of the air flow carrying the fiber aggregate 1 is high at the center part and low at the side part to cause the trouble of excessive filling of the fiber aggregate 1 at the center part of the mold cavity C and insufficient filling at the side wall part. To prevent the trouble, the fiber aggregate is preparatorily applied to the side wall part of the mold cavity liable to cause insufficient filling. However, such process undoubtedly necessitates labors and excess process to cause the increase in the molding cost.

To solve the problem, the velocity distribution of air exhausted from the mold cavity C is uniformized in the cross-section of the flow channel in the present invention, and a straightening member 17 is installed as a means therefor as shown in the FIGS. 3-(C) to (E). Such straightening member 17 is, for example, a perforated plate, a honeycomb plate, a metal mesh, a woven or knit fabric or a porous sintered material having air permeability. Plural kinds of the members and/or plural number of the members may be used in combination. The material of the member is metal, ceramic, plastic, etc. The velocity distribution of the carrier gas flow at the exhaustion side can be uniformized, as shown in the FIGS. 3-(C) to (E), by using a straightening member having high air transmission resistance at the central part and low resistance at the side wall reverse to the velocity distribution. Consequently, the fiber aggregate 1 can be uniformly charged by the process of the present invention successively from the deepest part of the mold cavity C. There is no problem of the conventional process to cause the accumulation of the fiber aggregate at the central part or the necessity for the preparatory charging of the fiber aggregate on the side wall part.

Another embodiment of the present invention is to place a resistance member on the air-sucking face of the mold cavity C to control the bulk density of the fiber aggregate on the air-sucking face to a desired bulk density. A material similar to the material of the straightening member 17 can be used in the resistance member 18, provided that the heat-resistance and durability have to be taken into consideration in the case of using a plastic material owing to the heating process applied to the upper and the lower molds 6 and 8. Furthermore, an easily bendable plate material is preferable to apply the material along the curved face of the mold cavity.

The action of the above resistance member 18 is described in detail with reference to the FIG. 3-(E). The inventors of the present invention have found that the filling density of fiber aggregate increases on the sucking face of a mold in the method for filling fiber aggregate in a mold by air-blowing when the sucking pressure is higher than the blowing pressure of the fiber aggregate.

The fiber aggregate blown into a mold cavity collides against the deepest part of the mold cavity and begins to deposit from the deepest part, and a sucking force caused by the exhaust fan 16 shown in the FIG. 1 is also applied to the collision face (the face having the resistance member 18). The sucking force on the collision face is strong compared with the sucking force on the side wall of the mold cavity C. Accordingly, the bulk density of the fiber aggregate depositing on the collision face becomes inevitably high. To uniformize the bulk density, a resistance member 18 is placed on the face having high suction force (corresponding to the collision face) in the embodiment of the present invention to lower the suction force at the collision face relative to the other parts (corresponding to the side walls). The suction force on the side wall of the mold cavity C is increased relative to the collision face by this process to achieve an extremely remarkable effect to enable the charging of the fiber aggregate to a desired bulk density even on the side wall part difficult to perform the charging of the fiber aggregate.

As an alternative method, the resistance member 18 is attached to the suction face of the mold cavity C and the suction force sucking the cavity from outside is varied during the charging process of the fiber aggregate to control the charged density of the fiber aggregate in the mold cavity to a desired level. In other words, the air velocity on the suction face of the mold cavity is controlled to a low level at the initial stage of filling to prevent the increase of the filling density at the initial stage.

It can be achieved, for example, by controlling the rotational speed of a driving motor of the air-sucking exhaustion fan 16 by an inverter or attaching a flow-controlling damper between a bypass channel R and the exhaustion fan 16. Such measures are not necessary for the upper and the lower faces of the mold cavity C since the aggregate is pressed, as to be described later, to a prescribed bulk density by compressing the mold.

The fiber aggregate can be charged to every part of the mold cavity at a desired bulk density by the above-mentioned procedures. As necessary, the charge of the fiber aggregate is stopped immediately after confirming the completion of the charge by the above-mentioned pressure gauges P1 to P3 and the procedure is shifted to the next step. In other words, after completing the charge of a prescribed amount of fiber aggregate in the mold cavity, the blowing port of fiber aggregate is closed, the upper and the lower molds 6 and 7 are moved in the compressing directions by actuating the actuators 8 and 9, and the fiber aggregate is pressed to a prescribed bulk density to complete the charging step.

A blower 12 for sending hot air and/or cold air is provided for molding the fiber aggregate charged in the mold cavity C, and hot air and/or cold air are supplied from a blowing chamber 11 to the lower face of the lower mold cavity and the by-pass circuit R by the blower 12. Air of room temperature is usually preferable as the cooling air, however, air forcedly cooled with a refrigerator may be used if a certain cost increase is allowable. An exhaustion chamber 13 is placed on the upper face of the mold cavity C and the by-pass channel R and the hot air and/or cold air are exhausted through the upper face by an exhaustion fan 14. The use of air as the hot gas and/or the cold gas is preferable in the present invention taking consideration of its availability and the reduction of the molding cost, however, use of other gases such as nitrogen is also allowable.

As described above, the present invention can minimize the heating time of a mold and the influence of the deviation of the flow and the wind pressure of hot air passing through the fiber aggregate filled in the mold cavity in molding to attain an extremely remarkable effect of getting a molded article free from mold unevenness and having excellent quality.

I claim:

1. A method for molding a fiber aggregate composed of a matrix consisting of crimped synthetic staple fibers and binder fibers having a melting point lower than that of the staple fiber and dispersed in the matrix by charging a cavity of an air-permeable mold with loosen fiber aggregate carried on carrier gas flow, compressing the fiber aggregate charged in the mold cavity to a prescribed bulk density, passing hot air through the compressed fiber aggregate to effect the thermal fusion of the binder fibers and the partial welding of the fibers of the fiber aggregate and passing cooling air through the product to effect the solidification and bonding of the welded part to obtain a cushion structure, characterized in that the mold is pressed at least once stepwise or continuously leaving a compression margin before getting the final form of the cushion structure in the heating and/or cooling of the fiber aggregate before converting the aggregate into the cushion structure to relax the thermal shrinkage of the fiber aggregate, and the aggregate is pressed with the mold to an extent corresponding to the compression margin to obtain the final shape of the cushion structure.

2. A method for molding a fiber aggregate described in the claim 1, characterized in that a by-pass channel of hot air is formed to surround the outer circumference of the side wall of the mold cavity essentially excluding the upper and the lower faces of the cavity, hot gas is passed through the fiber aggregate charged in the mold cavity and at the same time, through the by-pass circuit.

3. A method for molding a fiber aggregate described in the claim 1, characterized in that a heater is provided to prevent the temperature drop of the hot air before the arrival of the hot air to the aforementioned mold cavity and by-pass circuit, thereby preventing the lowering of the initial passing temperature of the hot air and keeping the temperature at a definite level by the heater.

4. A method for molding a fiber aggregate described in the claim 1, characterized in that the variation of the pressure of the carrier gas flow according to the progress of the filling of the fiber aggregate in the mold cavity is detected and the charging of the fiber aggregate into the mold cavity is stopped when the pressure variation reaches a preset level showing the completion of the filling of the fiber aggregate in the mold cavity.

5. A method for molding a fiber aggregate described in the claim 4, characterized in that the air in the mold cavity is sucked from outside, the increment of the pressure of blowing air flow at the side of blowing the fiber aggregate into the mold cavity with the carrier gas flow and the decrement of the pressure of air sucking the outside of the mold cavity are detected, and the amount of the fiber aggregate to be charged into the mold cavity is controlled by the difference between the blowing air pressure and the sucking air pressure.

6. A method for molding a fiber aggregate described in the claim 4, characterized in that a straightening member to straighten the air flow sucked from outside of the mold cavity is provided to uniformize the velocity distribution of air exhausted from the mold cavity in the cross-section of the flow channel.

7. A method for molding a fiber aggregate described in the claim 4, characterized in that a resistance member is placed on the air-sucking face of the mold cavity, and the bulk density of the fiber aggregate on the air-sucking face is controlled to a desired bulk density by the resistance member.

8. A method for molding a fiber aggregate described in the claim 4, characterized in that the suction force to suck the mold cavity from outside is varied during the charging process of the fiber aggregate to control the density of the fiber aggregate charged to the mold cavity to a desired charging density.

* * * * *